US006923385B2

(12) United States Patent
Koponen

(10) Patent No.: US 6,923,385 B2
(45) Date of Patent: Aug. 2, 2005

(54) NOZZLE FOR COATING SURFACES

(76) Inventor: Vesa Koponen, Heinäkarinkatu 8, FIN-20300 Turku (FI)

( * ) Notice: Subject to any disclaimer, the term of this patent is extended or adjusted under 35 U.S.C. 154(b) by 0 days.

(21) Appl. No.: 10/482,113

(22) PCT Filed: Jun. 25, 2002

(86) PCT No.: PCT/FI02/00560

§ 371 (c)(1),
(2), (4) Date: Jul. 22, 2004

(87) PCT Pub. No.: WO03/000430

PCT Pub. Date: Jan. 3, 2003

(65) Prior Publication Data

US 2004/0251320 A1 Dec. 16, 2004

(30) Foreign Application Priority Data

Jun. 25, 2001 (FI) ..... 20011341

(51) Int. Cl.[7] ..... B05B 7/06

(52) U.S. Cl. ..... 239/424; 239/423; 239/422; 239/424.5; 239/428; 239/433

(58) Field of Search ..... 239/420, 422, 239/423, 424, 424.5, 428, 433

(56) References Cited

U.S. PATENT DOCUMENTS

| | | | | |
|---|---|---|---|---|
| 3,929,291 A | | 12/1975 | Ladisch | |
| 4,284,242 A | * | 8/1981 | Randell | 239/422 |
| 4,502,633 A | * | 3/1985 | Saxon | 239/424 |
| 4,525,175 A | * | 6/1985 | Stellaccio | 239/424 |
| 4,600,151 A | * | 7/1986 | Bradley | 239/422 |
| 4,788,011 A | | 11/1988 | Busse et al. | |
| 4,887,962 A | * | 12/1989 | Hasenack et al. | 239/433 |
| 5,560,896 A | | 10/1996 | Bewersdorf et al. | |
| 6,360,677 B1 | * | 3/2002 | Robillard et al. | 239/422 |
| 6,565,010 B2 | * | 5/2003 | Anderson et al. | 239/423 |

FOREIGN PATENT DOCUMENTS

| | | |
|---|---|---|
| DE | 2 326 440 | 12/1974 |
| DE | 31 45 390 A1 | 5/1983 |
| FR | 2 594 528 A1 | 8/1987 |
| JP | 2000-153182 A | 6/2000 |

* cited by examiner

*Primary Examiner*—Steven J. Ganey
(74) *Attorney, Agent, or Firm*—Kubovcik & Kubovcik

(57) ABSTRACT

The present invention relates to a nozzle for mixing at least two fluid substances together for coating a surface with a reaction product of said fluid substances and possibly a reaction product of the aforesaid substances and the surface material to be sprayed with them, said nozzle comprising substantially concentric channels for each fluid substance, the orifices of said channels being disposed close to each other at the end of the nozzle. According to the invention, between the concentric channels for fluid substances to be mixed together, the nozzle has a likewise substantially concentric intermediate channel connected to a compressed air source, the orifice of the intermediate channel connected to the compressed air source has a tapered form and a diameter at most equal to the inner diameter of the intermediate channel, and the orifice of the intermediate channel is directed obliquely towards the center axis of the nozzle.

11 Claims, 3 Drawing Sheets

NOZZLE FOR COATING SURFACES

Figure 1:
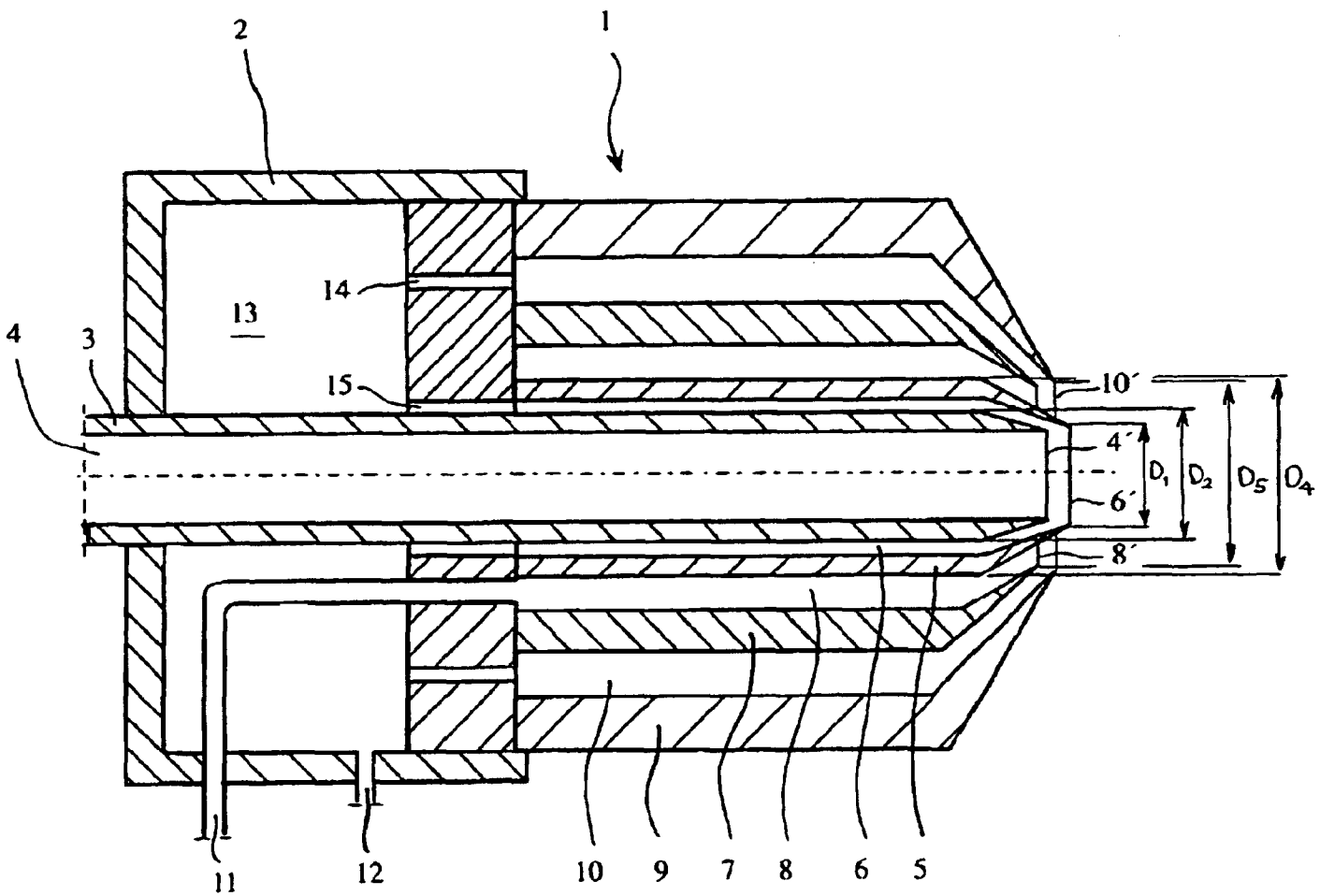

The present invention relates to a nozzle designed to be used for coating, painting and/or otherwise treating surfaces with a reaction product of at least two fluid substances mixing and/or reacting with each other or possibly with a reaction product of said substances and the surface material of the object to be sprayed, in which nozzle the mixing of the substances takes place in an outer space after the nozzle, and which nozzle has concentric channels for each fluid substance, the orifices of said channels being placed close to each other at the end of the nozzle.

In prior art, numerous nozzles and nozzle combinations for spraying substances, designed for the coating of surfaces, are known, in which the mixing of the substances to be sprayed occurs in the nozzle. However, it is obvious that this kind of nozzles are not applicable for use with combinations of substances that react quickly with each other—while still in the nozzle—thus blocking the nozzle.

At present, substance pairs reacting quickly with each other are often sprayed from separate nozzles with a sufficient distance between them. The mixing of the sprayed substances in this type of nozzles is more or less non-uniform—resulting in non-uniform quality of the reaction product. The distance between the nozzles also means a larger size of equipment and a greater possibility of external conditions—such as e.g. wind—influencing the result.

There are also nozzles in which substance pairs are sprayed from contiguous apertures and in which the substances therefore only meet and react with each other in the air space outside the nozzle. The use of such nozzles is subject to limitations such as—on the one hand—turbulence of air currents occurring in the outflow area of the nozzle, as a result of which a solid reaction product sticks to the outer surface of the nozzle, thus increasing the layer that blocks the nozzle, and—on the other hand—clogging of the nozzle due to the small size of the nozzle apertures.

Patent specification U.S. Pat. No. 4,788,011 discloses a nozzle for supplying two fluid substances that react with each other, producing a powdery salt, separately from two concentric channels, which fluid substances are set into gyratory motion about the nozzle axis by means of spiral fins before being discharged from their channels, so that they are discharged from their channels as conical jets intersecting outside the nozzle. This nozzle is not intended for the coating of surfaces and it would not be applicable for that use due to the type of spray it produces and the risk of clogging caused by the fins.

The object of the present invention is thus to achieve a manually operated and reliable nozzle of the type specified in the preamble for the coating of surfaces, the spray discharged from said nozzle being easy to direct to a desired spot, even narrow places.

The essential point about the nozzle of the invention is that, between the concentric channels for fluid substances to be mixed together, such as liquids, suspensions, masses, powders etc., it has a likewise concentric intermediate channel for a gaseous medium, such as air, steam, nitrogen or the like, which is connected to a pressure source. The flow of gaseous medium supplied from the intermediate channel serves to keep the fluid substances coming from the middle and outer channels clear of the edge of the channel orifice—thereby greatly contributing towards keeping the nozzle unclogged. At the same time, by creating a zone of higher pressure between the flow fields, the gaseous medium prevents the flows of fluid substances from getting mixed prematurely on the surface of the nozzle—thus preventing clogging of the nozzle. The gaseous medium may also participate in the reaction between the fluid substances as a catalyst and/or reactant, e.g. as an oxidizer.

Another feature essential to the invention is that the intermediate channel for gaseous medium connected to a pressure source has a conically tapering shape in the region near the orifice so that the diameter of the tapered orifice of the intermediate channel is equal to or somewhat smaller than the inner diameter of the actual intermediate channel. In the most preferable case, the orifice of the intermediate channel is larger than the orifice of the middle channel, so that the fluid substance supplied from the middle channel will not touch the edges of the intermediate channel orifice. The flow of gaseous medium from the intermediate channel also functions as an ejector of the fluid substance supplied from the outer channel. The conical part of the intermediate channel guides the ejected mixture issuing from the outer channel towards the flow of gaseous medium coming from the intermediate channel, which intersects the flow of the substance to be mixed coming from the middle channel, thus causing the substances supplied from the channels of the nozzle to be effectively mixed with each other. In addition, the gas flow simultaneously functions—as is known in prior art—as a factor determining the angle of dispersion of the mixture of the fluid substances merged, as well as a key factor determining the jet length and droplet or particle formation of the spray.

A third essential feature of the nozzle of the invention is that the intermediate channel of circular cross-section tapers in the part near the orifice obliquely towards the center axis of the nozzle. This feature contributes to the formation of a uniform and symmetric flow field and to a uniform quality of the spraying result. In the free space, the inwards directed gas flow spreads out, causing the fluid substances to be effectively mixed together.

The efficiency of the nozzle of the invention can additionally by increased by providing it with a concentric outermost channel placed outside the outer channel for fluid substance and connected to the pressure source for gaseous medium. A gas flow as mentioned above promotes the ejection and mixing of especially fluid substances having a greater viscosity. It can also be utilized for influencing the direction of the mixture flow, the droplet or particle formation and jet length. In certain cases, the same effect can be achieved by connecting the middle channel and/or the outer channel for fluid substance to the pressure source for gaseous medium, in which case a mixture of fluid substance and gaseous medium is discharged from the channel or channels in question.

According to a preferred embodiment, the part of the outer channel for fluid substance near the orifice is conically tapered and directed obliquely towards the center axis of the nozzle.

According to a preferred embodiment of the invention, the inner edge of the outer channel for fluid substance extends farthest from the nozzle, forming a kind of "material umbrella" between the flows of fluid substances. Together with the gaseous medium discharged from the intermediate channel, it prevents the fluid substances from merging in the nozzle, yet at the same time bringing the fluid substance flowing from the outer channel as close as possible to the fluid substance flowing from the middle channel, thus enhancing the ejector effect of the intermediate channel as well as the mixing of the fluid substances. The diameter of the orifice of the inner edge of the outer channel is preferably larger than the diameter of the middle channel orifice in order that the fluid substance supplied from the middle channel should not come into contact with it.

The channel orifices preferably have sharp edges. This has a favorable effect, among other things, on the gas flow in the immediate vicinity of the surface and helps achieve more effective sweeping of the surfaces while reducing turbulence at the edge of the orifice. This also allows easier detachment of droplets or particles from the orifices of the channels of the nozzle.

In a particularly preferred embodiment of the invention, the conicality of the nozzle channels in the area near the orifices increases from the middle channel towards the outermost channel. This arrangement is designed to direct the flows discharged from all channels substantially to the same "focus or focal area" on the center axis of the nozzle, which further increases the efficiency of mixing of the substances with each other.

In the tapering parts at the ends of the channel or channels for gaseous medium, the inner surfaces of the orifices may be of conical shape. However, their tapering form may also be curvilinear, in which case the gas currents will follow these curved surfaces more readily. In this case, the currents will follow the surface in the rounded area as well, without causing turbulence (Coanda effect). This is another factor that helps keep the surfaces clean.

According to a preferred embodiment, the nozzle may be provided with compressed air jets, preferably of a point-form design, placed at either side of the nozzle end and directed obliquely towards each other and towards a point in front of the nozzle, said jets serving to flatten the conical spray discharged from the nozzle into a substantially planar plume when necessary, e.g. when coating the edges of a planar surface.

According to a preferred embodiment, to permit adjustment of the droplet size, jet length and spray angle of the mixture discharged from the nozzle, the middle channel and/or any tube surrounding it is axially movable e.g. by means of a screw-type coupling, to allow adjustment of the size of the orifice of any channel, preferably within a range of about 0–2 mm.

In the following, the invention will be described in detail with reference to the attached drawings, wherein FIG. 1 presents a sectioned side view of a nozzle according to the invention.

Figure 2:
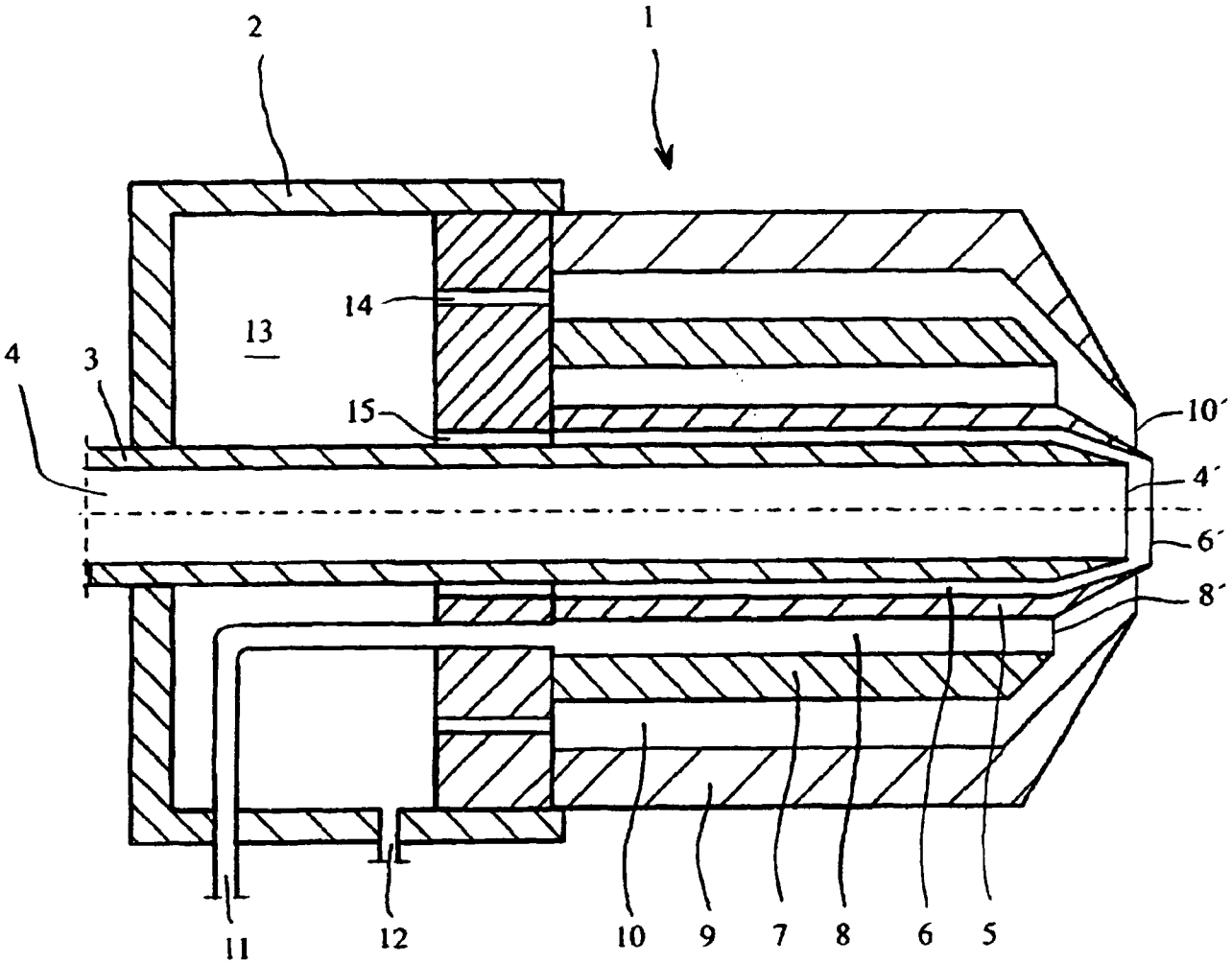

FIG. 2 presents a sectioned side view of another nozzle according to the invention.

Figure 3:
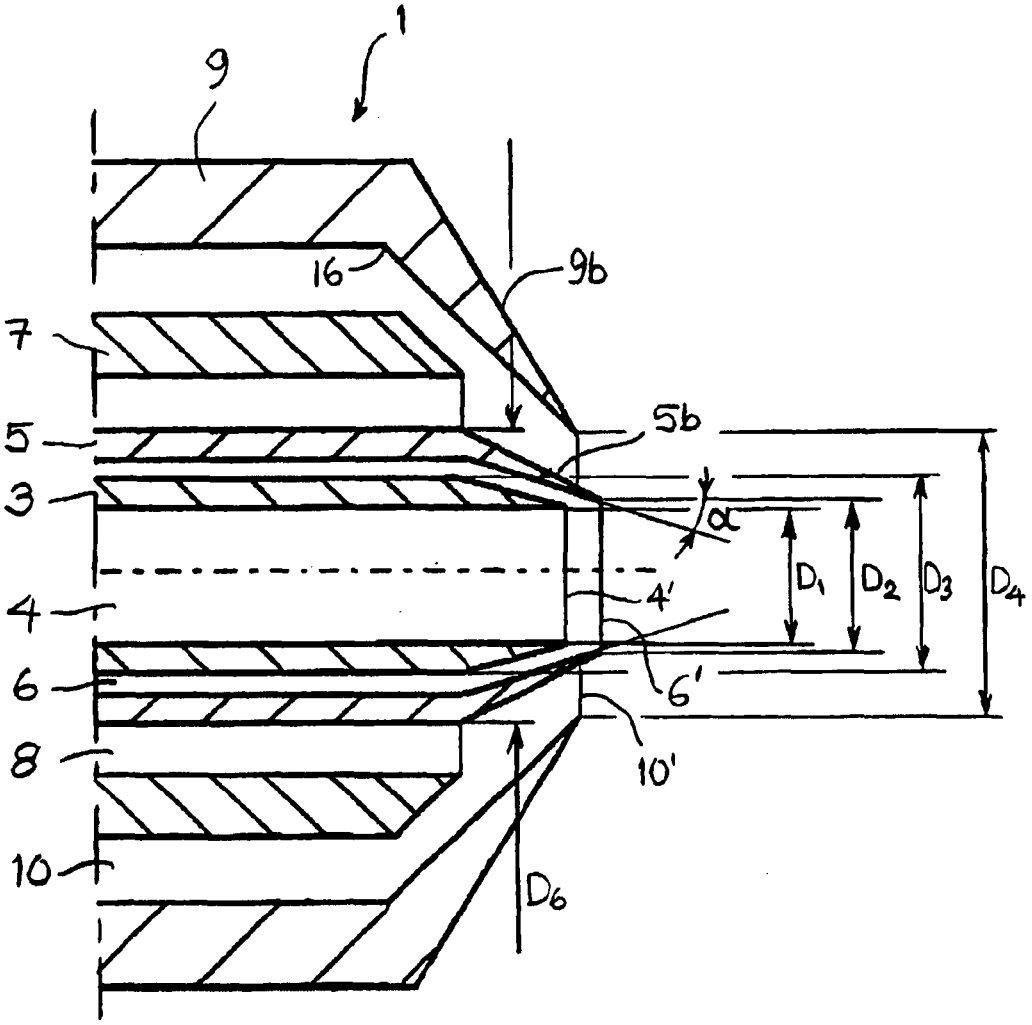

FIG. 3 presents a detail of the nozzle in FIG. 2.

In FIG. 1, the nozzle is generally designated by reference number 1 while the nozzle frame is indicated by reference number 2. The frame 2 encloses a compressed air chamber 13, which is connected to a compressed air source via channel 12. A central tube 3 passing through the frame 2 forms a middle channel 4 for a fluid substance, such as e.g. a hardenable liquid coating substance. The fluid substance is discharged from the central tube 3 orifice 4', which has sharp edges formed by chamfering the end of the central tube 3 from the outside so as to form a cone tapering towards the edge.

The nozzle 1 in FIG. 1 has an intermediate tube 5 outside and concentric with the central tube 3. Between the intermediate tube 5 and the central tube 3, an intermediate channel 6 of circular cross-section is thus formed, and this channel communicates with the compressed air chamber 13 via an aperture or apertures 15. In the portion near the orifice 6', the end of the intermediate tube 5 is so tapered that both the inner surface and the outer surface of the intermediate tube 5 are tapering cones. The edges of the narrowed orifice 6' of the intermediate tube 5 are sharp and its diameter $D_1$ is smaller than the external diameter $D_2$ of the non-tapered part of the actual central tube 3. In a most preferred case, the diameter $D_1$ of the orifice 6' of the intermediate tube 5 is larger than the diameter of the orifice 4' of the central tube 3, so that the fluid substance supplied from the central tube 3 will not touch the edge of the orifice 6' of the intermediate tube 5. Moreover, the intermediate tube 5 extends farthest of all in the nozzle over the central tube 3, thus forming a kind of umbrella over the central tube 3.

The intermediate tube 5 is again concentrically surrounded by a tube 7 which, together with the intermediate tube 5, forms a channel 8 of circular cross-section for a fluid substance, such as e.g. a liquid accelerant, which is supplied into the channel 8 from a pipeline 11. In this embodiment, tube 7 is slightly shorter than the central tube 3 and its sharp-edged orifice 8' has a diameter smaller than the external diameter of the intermediate tube 5.

In the nozzle in FIG. 1, the outermost concentric tube 9 and the tube 7 inside it delimit between them a channel 10 of circular cross-section, which communicates with the compressed air chamber 13 via an aperture or apertures 14. The end of the outermost tube 9 near the orifice 10' is also tapered so that both the inner surface and the outer surface of the tube 9 are tapered cones and the orifice 10' has sharp edges. The diameter $D_5$ of the orifice 10' is approximately the same as the external diameter $D_4$ of the intermediate tube 5 in its non-tapered part. The outermost tube 9 is shorter than the intermediate tube 5 but longer than the central tube 3.

The orifices 4', 6', 8', 10' of all the tubes 3, 5, 7, 9 are chamfered and sharp-edged. In addition, the ends of all the tubes 5, 7, 9 concentrically surrounding the central tube 3 have been narrowed by being formed as tapering cones. In the embodiment in FIG. 1, the nozzle has an angular shoulder between the cylindrical tubes and the cones, but the tube ends can also be narrowed in a gentle fashion by using curved surfaces. Such an embodiment is not presented in the drawings.

During use of the nozzle, the jet of liquid coating substance sprayed from the middle channel 4 and the jet of accelerant sprayed from channel 8 meet outside the end of the nozzle 1 somewhere near its center axis and are mixed in the air space outside the nozzle in a controlled manner, assisted by the compressed air jets discharged from the intermediate channel 6 and the outermost channel 10, without a risk of the nozzle being clogged. However, the tubes forming the aforesaid channels are preferably separable from each other to allow them to be cleaned.

FIG. 2 corresponds to the embodiment in FIG. 1 in all other respects except that the end of the tube 7 surrounding the intermediate tube 5 is not shaped in the form of tapering cones as in the embodiment presented in FIG. 1. Instead, a sharp edge the orifice 8' has been formed by chamfering the outer surface of the tube 7 into a conical form, as in the case of the central tube 3, too.

FIG. 3 presents a detail of the nozzle 1. As can be seen from the figure, the intermediate tube 5 and the outermost tube 9 have conically tapered end portions 5*b* and 9*b*, which direct the circular currents of gaseous medium towards the center axis of the nozzle. In this embodiment, the tapered portions 5*b* and 9*b* are shaped as conical surfaces, but instead of these it would also be possible to have surfaces curved in the direction of flow. In that case, the nozzle would have no angular shoulder 16 between the cylindrical channel and the tapering cone.

The flow of gaseous medium discharged from the middle channel 6 is narrowed and directed at an angle $\alpha$ towards the center axis of the nozzle. The diameter $D_2$ of the orifice 6' of the intermediate channel 6, which is the most protruding part of the nozzle 1, is preferably larger than the diameter $D_1$ of the orifice 4' of the middle channel 4. Likewise, $D_4$ is approximately equal to $D_5$.

What is claimed is:

1. Nozzle for mixing at least two fluid substances together for coating a surface with the mixture of said fluid substances or with their reaction product or, optionally, with a reaction product of the aforesaid substances and the surface to be coated with them, said nozzle (1) comprising substantially concentric inner and outer channels (4, 8) each for one of said at least two fluid substances, at least one channel (6, 10) for gaseous medium, and orifices (4', 8') of channels (4, 8) which are disposed close to each other at the end of the nozzle (1), characterized in that between the concentric channels (4, 8) for fluid substances to be mixed with each other, one of said at least one channel (6, 10) for gaseous medium is arranged as a substantially concentric intermediate channel (6), connected to a pressure source (12) for the gaseous medium, and the end of the intermediate channel (6) connected to the pressure source (12) for the gaseous medium has a conically or curvedly tapering form and a sharp edge and is directed obliquely towards the center axis of the nozzle (1), and that the diameter of an orifice (6') of the intermediate channel (6) is smaller or equal to the inner diameter of said intermediate channel (6) before the tapering point, and the orifice (6') of the intermediate channel (6) extends father than the orifice (4') of the inner channel (4).

2. Nozzle (1) according to claim 1, characterized in that it has outside the outer channel (8) for a fluid substance a substantially concentric outermost channel (10) connected to the pressure source (12) for the gaseous medium, the end of the outermost channel (10) near the orifice (10') being conically or curvedly tapering and obliquely directed towards the center axis of the nozzle (1).

3. Nozzle (1) according to claim 1, characterized in that an end of the outer channel (8) has a circular cross-section and has a conically or curvedly tapering shape near the orifice (8') and directed obliquely towards the center axis of the nozzle (1).

4. Nozzle (1) according to claim 1, characterized in that the inner and/or outer channel (4, 8) for fluid substance is also connected to the pressure source (12) for the gaseous medium.

5. Nozzle (1) according to claim 2, characterized in that the orifices (4', 6', 8', 10') of the channels (4, 6, 8, 10) have sharp edges.

6. Nozzle (1) according to claim 5, characterized, in that the angle of the cones near the orifices (4', 6', 8', 10') of the channels (4, 6, 8, 10) relative the center axis of the nozzle (1) increases from the middle channel (4) towards the outermost channel (8 or 10).

7. Nozzle (1) according to claim 2, characterized in that the inner surfaces of the tapered portions near the orifices (6', 10') of the channel or channels (6, 10) for a gaseous medium are curved in the direction of flow.

8. Nozzle (1) according to claim 1, characterized in that the nozzle (1) has compressed air jets, of a point-form design, placed at either side of the nozzle end and directed obliquely towards each other and towards a point in front of the nozzle end in order to flatten a spray discharged from the nozzle into a substantially planar spray.

9. Nozzle (1) according to claim 1, characterized in that an end of a middle tube (3) forming the inner channel (4) is axially movable to allow adjustment of the size of a circular orifice of the intermediate channel (6), within a range of 0–2 mm.

10. Nozzle (1) according to claim 2, characterized in that a tube (7 or 9) is mounted in the nozzle (1) with a threaded coupling so that an end of the tube is axially movable to allow the size of a gap of the circular orifice (8' or 10') of the channel (8 or 10) to be adjusted, within a range of 0–2 mm.

11. Nozzle (1) according to claim 2, characterized in that the end of the outer channel (8) of circular cross-section has a conically or curvedly tapering shape near the orifice (8') and directed obliquely towards the center axis of the nozzle (1).

* * * * *